US007408302B2

(12) United States Patent
Min

(10) Patent No.: US 7,408,302 B2
(45) Date of Patent: Aug. 5, 2008

(54) PLASMA DISPLAY PANEL

(75) Inventor: Woong-Kee Min, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/466,646

(22) Filed: Aug. 23, 2006

(65) Prior Publication Data

US 2007/0046201 A1 Mar. 1, 2007

(30) Foreign Application Priority Data

Aug. 23, 2005 (KR) ..... 10-2005-0077423

(51) Int. Cl.
*H01J 17/49* (2006.01)
*G09G 3/38* (2006.01)

(52) U.S. Cl. ..... 313/582; 313/586; 313/587

(58) Field of Classification Search ..... 313/582–587, 313/292; 315/169.4; 345/30, 37, 60; 445/23–25
See application file for complete search history.

(56) References Cited

U.S. PATENT DOCUMENTS

| | | | | |
|---|---|---|---|---|
| 6,008,582 | A * | 12/1999 | Asano et al. | 313/582 |
| 2005/0110412 | A1* | 5/2005 | Lee | 313/587 |
| 2006/0001377 | A1* | 1/2006 | Hur et al. | 313/584 |
| 2006/0043883 | A1* | 3/2006 | Hong et al. | 313/505 |
| 2006/0066239 | A1* | 3/2006 | Hasegawa et al. | 313/586 |

* cited by examiner

*Primary Examiner*—Joseph L. Williams
*Assistant Examiner*—Elmito Breval
(74) *Attorney, Agent, or Firm*—Fish & Richardson P.C.

(57) ABSTRACT

A plasma display panel is disclosed. The plasma display panel includes first barrier ribs partitioning a plurality of sub pixels, and second barrier ribs partitioning neighboring unit pixels wherein the plurality of sub pixels form one unit pixel. A width of each of the second barrier ribs partitioning the unit pixels is wider than that of each of the first barrier ribs partitioning the plurality of sub pixels. A sub pixel located at the center of the plurality of sub pixels is a blue sub pixel.

20 Claims, 3 Drawing Sheets

PLASMA DISPLAY PANEL

This Nonprovisional application claims priority under 35 U.S.C. § 119(a) on Patent Application No. 10-2005-0077423 filed in Korea on Aug. 23, 2005 the entire contents of which are hereby incorporated by reference.

BACKGROUND

1. Field

This document relates to a plasma display panel.

2. Related Art

A plasma display panel (PDP) comprises a phosphor layer within a discharge cell partitioned by barrier ribs and a plurality of electrodes for applying a driving signal to the discharge cell.

In the PDP, if the driving signal is applied to the discharge cell, a discharge gas filled within the discharge cell generates vacuum ultraviolet rays. The vacuum ultraviolet rays emit phosphors within the discharge cell, thereby implementing an image.

In recent years, there has been much research done in order to solve maximize the quality of the PDP. As part of it, there has been active research done in order to increase emission efficiency by coating a greater amount of phosphors effectively.

SUMMARY OF THE INVENTION

The present invention provides a PDP that can improve a color mixture property that is visually felt by improving pixel cells and barrier ribs and can also improve the sharpness by reducing a phenomenon in which the screen is blurred.

Furthermore, the present invention provides a PDP that can improve not only luminance, but also a contrast characteristic by improving a unit pixel and barrier ribs.

In one aspect, a PDP comprises a front panel comprising a dielectric layer formed to cover a plurality of sustain electrode pairs, a rear panel comprising address electrodes formed to cross the sustain electrode pairs, and barrier ribs comprising phosphor materials between the front panel and the rear panel.

Implementations may include one or more of the following features. For example, the PDP may further comprise a color filter, which is formed on the front substrate, below the front substrate, or between the plurality of sustain electrode pairs and the dielectric layer.

The phosphor materials may comprise red (R), green (G), and blue (G) phosphor materials.

In another aspect, a PDP comprises a front panel comprising a dielectric layer formed to cover a plurality of sustain electrode pairs, a rear panel comprising address electrodes formed to cross the sustain electrode pairs, barrier ribs comprising a white phosphor material that generates white light between the front substrate and the rear substrate, and a color filter formed on the front substrate, below the front substrate, or between the plurality of sustain electrode pairs and the dielectric layer.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

BRIEF DESCRIPTION OF THE DRAWINGS

The accompany drawings, which are comprised to provide a further understanding of the invention and are incorporated on and constitute a part of this specification illustrate embodiments of the invention and together with the description serve to explain the principles of the invention.

DETAILED DESCRIPTION OF PREFERRED EMBODIMENTS

Reference will now be made in detail embodiments of the invention examples of which are illustrated in the accompanying drawings.

Figure 1:
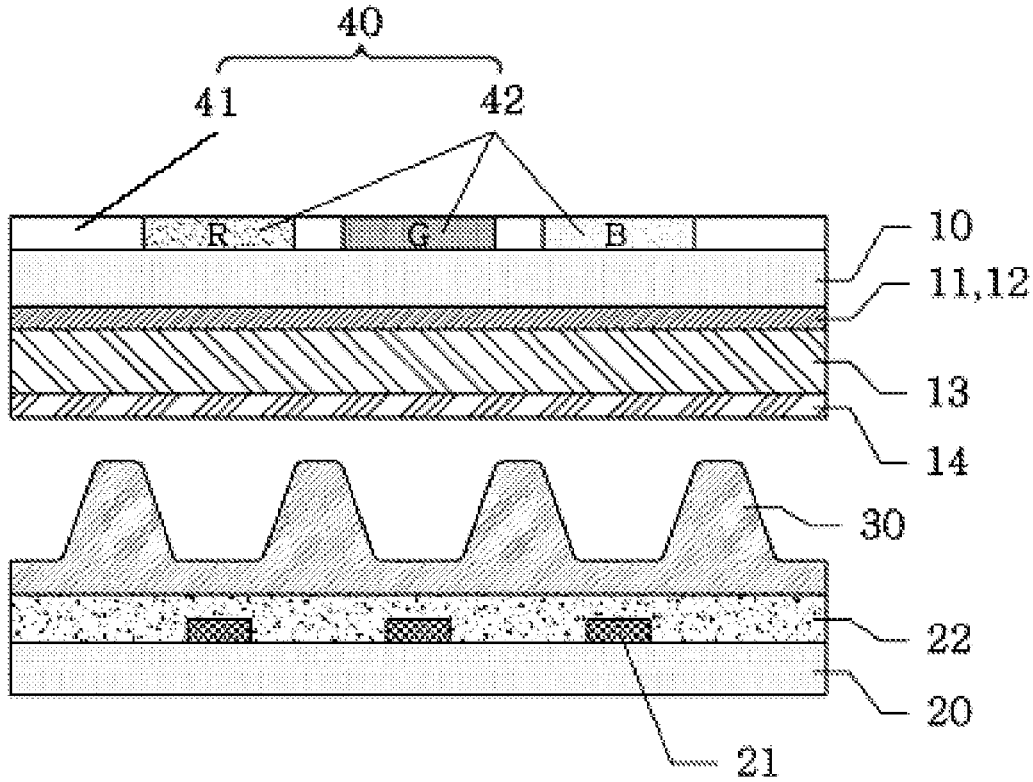
FIG. 1 is a cross-sectional view showing the construction of a PDP according to an embodiment of the present invention.
Figure 2:
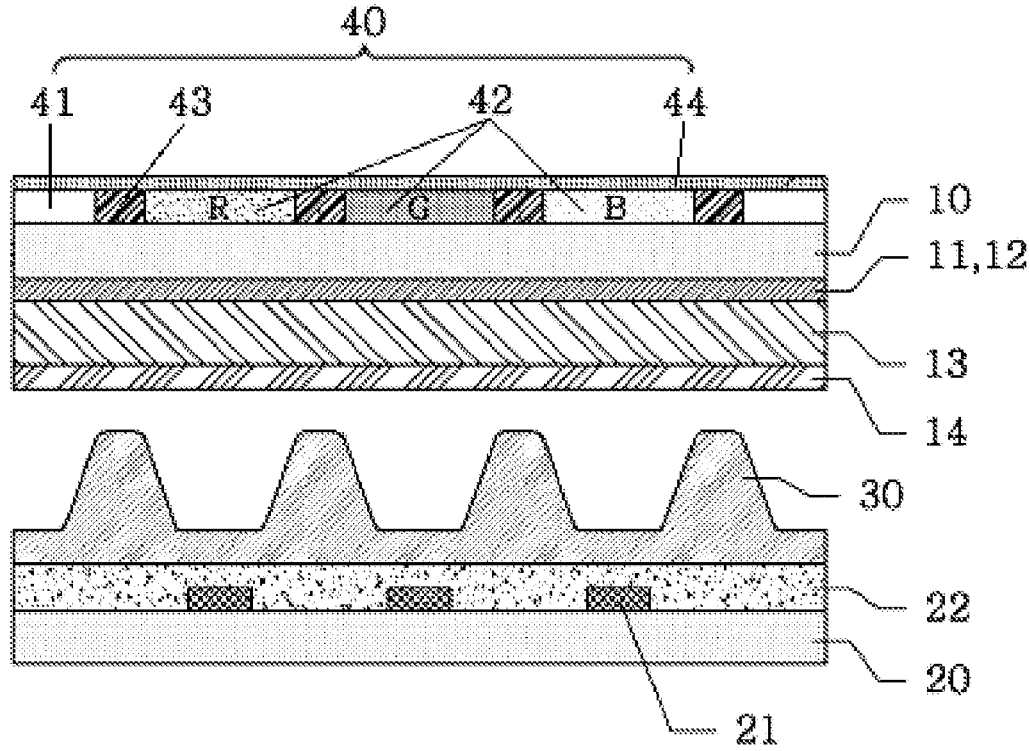
FIG. 2 is a cross-sectional view showing the construction of a PDP according to another embodiment of the present invention.

FIGS. 1 and 2 are cross-sectional views showing the structure of a PDP according to the present invention.

As shown in the drawings, the PDP comprises a front panel and a rear panel that are coalesced at a predetermined distance.

The front panel comprises a front substrate 10 on which plural pairs of sustain electrodes 11 and 12 are formed, a front dielectric layer 13 formed to cover the sustain electrodes 11 and 12, and an MgO layer 14 formed on a rear surface of the front dielectric layer 13.

Furthermore, the front panel comprises a color filter 40 formed on a top surface of the front substrate 10.

The rear panel comprises a rear substrate 20 spaced apart from the front substrate 10 at a predetermined distance, a plurality of address electrodes 21 that are formed on the rear substrate to cross the sustain electrode pairs, a rear dielectric layer 22 covering the address electrodes 21, and barrier ribs 30 formed of a material containing a phosphor material that becomes phosphor by ultraviolet rays. The barrier ribs 30 cover a top surface of the rear dielectric layer 22 and have predetermined patterns so as to form the discharge cells.

The phosphor material (i.e., the material of the barrier ribs) may be a white phosphor material, but may also comprise red (R), green (G), and blue (B) phosphor materials.

In an embodiment of the present invention, it has been described that the barrier ribs 30 comprise the rear panel. However, the barrier ribs 30 may be formed below a protection layer of the front panel.

Furthermore, the structure of the barrier rib may have a stripe type or preferably have a closed type. The closed type barrier rib has a structure in which a traverse barrier rib (a second barrier rib) is connected to a longitudinal barrier rib (a first barrier rib). Accordingly, the closed type barrier rib structure has a strong mechanical strength and greatly improved emission efficiency because it has a wide area on which phosphors are coated in comparison with the stripe type barrier rib structure. That is, phosphors are coated on not only the longitudinal barrier ribs, but also the traverse barrier ribs.

Accordingly, emission efficiency can be improved significantly since lots of light can be generated through once discharge.

In the PDP constructed above according to an embodiment of the present invention, the manufacturing cost can be saved and the manufacturing time can be shortened since the processes of forming the barrier ribs and the phosphors are integrated into one process.

Furthermore, the barrier ribs emit themselves, comprising the phosphor material. Accordingly, since a discharge space can be widened as compared with the prior art, high definition of discharge cells can be realized and emission efficiency can be improved accordingly.

In the related art, discharge characteristics between discharge cells on which R, G, and B phosphors are coated are different because the physical properties of the R, G, and B phosphors are different. However, the present invention can facilitate complicate driving conditions for color implementation.

Furthermore, the present invention can solve the conventional problems, such as that the dielectric constant is relatively increased, a driving voltage rises, a discharge delay time is extended, invalid power is increased, and consumption power is increased, which are generated since the phosphors are coated on the barrier ribs.

The material and manufacturing method of the front substrate 10, the rear substrate 20, the plural pairs of sustain electrodes 11 and 12, the front and rear dielectric layers 13 and 22, and the MgO layer 14, which are comprised in the front panel and the rear panel, are not limited to those known in the technical field of the present invention, and may be selectively used. Accordingly, the material and manufacturing method will not be described in detail because they are well known.

In the PDP constructed above, ultraviolet rays occurring due to a discharge in the discharge cell emit the barrier ribs 30 made of a white phosphor material to emit white light. The emitted white light is selectively transmitted through the color filter 40, thus implementing colors.

The color filter 40 can improve daylight contrast by implementing colors and shielding unnecessary light transmitted from outside the PDP.

It is to be noted that the color filter 40 is not limited to the color filter used in the technical field of the present invention, but may use other color filters.

That is, the color filter 40 may comprises a base film 41, and R, G, and B color layers 42, as shown in FIG. 1, or may comprise the base film 41, the R, G, and B color layers 42, a black matrix 43, and a protection layer 44, as shown in FIG. 2.

In the color filter 40 as shown in FIG. 2, the black matrix 43 is formed between the respective color layers 42. The protection layer 44 is formed on the black matrix 43 and the color layers 42 in order to protect them from external short.

A material constituting the color layers 42 may be selected from materials that are known in the technical field of the present invention. In other words, the material may comprise transparent resin, a stain carrier comprising a precursor or a compound thereof, a stain or a compound thereof. Furthermore, an organic or inorganic dye may be used solely or as two or more kinds of combinations. Of the dyes, a dye having a high color-forming property and a high heat-resistant property, more particularly, a dye having a high heat-resistant and degradable property is preferably used. Alternatively, an organic dye may be used. It is preferred that red, green, and blue color materials be used. Alternatively, yellow, cyan, and magenta color materials may be used.

The manufacturing method of the color filter 40 is not specially limited, but may employ a dying method, a pigment dispersion method, an electrodeposition method, an inkjet method or the like.

In the dying method, a photosensitizer is added to a water-soluble polymer (i.e., a dying material), thus photosensitizing a polymer material. The photosensitized polymer material is coated on locations at which the color layers are located, forming a coating film. The coating film is patterned in predetermined form by a photolighography process. A substrate in which the coating film is patterned is dyed, thus forming a colored color filter.

In the pigment dispersion method, a photosensitive resin layer in which a pigment is dispersed is formed on locations at which color layers are formed. The photosensitive resin layer is patterned to form a mono color pattern. The above process is repeatedly performed to form a color filter colored with three colors.

In the electrodeposition method, an electrodeposition coating agent containing a pigment, resin, electrolyte, etc. is electrodeposited at locations at which the color layers are located. The above process is repeatedly performed to form a colored color filter.

Furthermore, the color filter 40 may be fabricated by an inkjet method. That is, coloring agents containing respective pigments (hereinafter, referred to as "ink") are sprayed at locations at which the color layers 42 are located on specific regions from respective nozzles. The ink is dried to form the color filter 40.

In accordance with the method, patterns of three colors can be formed at the same time. Furthermore, an amount of ink used can be reduced. Accordingly, the methods are advantageous in that they can increase the productivity significantly and save the cost.

In the case where the color filter is fabricated by the inkjet method, for example, in the color filter as shown in FIG. 1, a thin film is first formed on the base film by a sputtering, vacuum deposition or printing method and is then patterned by a photolithography method, etc., thus forming the black matrices.

A pigment dispersant composite for forming a red color material is then coated. Only a predetermined region is exposed using a photo mask. The predetermined region is developed to form a red color layer. The above process is repeatedly performed to form green and blue color layers. The protection layer 44 is then coated on the color layers, thereby completing the color filter 40.

In this case, after the color layers are formed, they may be hardened through a sintering process. At this time, the black matrices may be removed.

On the other hand, the barrier ribs 39 of the PDP according to an embodiment of the present invention may comprise a phosphor material that becomes phosphor with white color by ultraviolet rays. The phosphor material may be sufficiently distributed on the barrier ribs 30.

The barrier ribs may further comprise a silica-based material other than the phosphor material so as to reinforce the strength in forming the discharge cells.

The phosphor material comprised in the barrier rib may be a mixture of a red phosphor material, a green phosphor material, and a blue phosphor material. Experimentally, if the composition ratio of the red phosphor material, the green phosphor material, and the blue phosphor material is controlled while radiating vacuum ultraviolet rays, the white phosphor material can be obtained easily. Accordingly, description thereof will be omitted.

The red phosphor material, the green phosphor material, and the blue phosphor material are not limited to the phosphor materials known in the technical field of the present invention, but may comprise other phosphor material. Preferably, the red phosphor material may comprise (Y, Gd)BO3:Eu, Y2O3:Eu or Y(P,V)O4:Eu or may comprise a combination of them. The green phosphor material may comprise Zn2SiO4:Mn, (Y, Gd)BO3:Tb or YBO3:Tb. The blue phosphor material may comprise a Ba-based phosphor material, such as BaMgAlxOy:Eu (where x is an integer of 10 to 14 and y is an integer of 17 to 23), or a CaMgSi-based phosphor material, such as CaMgSi2O6:Eu, or may comprise a combination of the Ba-based phosphor material and the CaMgSi-based phosphor material.

A barrier rib comprising a phosphor material that becomes phosphor as the white color by ultraviolet rays may comprise only the white phosphor material that becomes phosphor as the white color, or a phosphor material having a color different from the white phosphor material. The shape of the barrier rib is not limited to that shown in FIGS. 1 and 2, but may comprise other shapes, such as stripe or delta. More preferably, the barrier rib may be a closed type barrier rib comprising a traverse barrier rib and a longitudinal barrier rib.

Furthermore, the barrier ribs 30 may be easily formed by applying a formation method of barrier ribs and a coating method of a phosphor material, which are known in the technical field of the present invention, and the method of forming the barrier ribs 30 is not limited to the above methods. That is, the method of forming the barrier ribs 30 may comprise a printing method employing a phosphor paste, a formation method employing a photoresist phosphor paste, a formation method employing a dry film, and the like. A sandblast method may also be used as the method of forming the barrier ribs 30.

For example, a paste comprising the white phosphor material is fabricated. The paste is printed and dried in the form of the barrier ribs 30. A binder is then burnt off through a sintering process, thereby completing the barrier ribs.

At this time, the composition of the paste may be a composition that is known in the technical field of the present invention. It is preferred that the composition of the paste comprise phosphor material powder, and an organic binder and an organic solvent for facilitating printing by giving viscosity to the phosphor material powder. The phosphor material powder is formed by processes, such as mixing, composing, grinding, grain-size controlling, cleaning, and surface processing of a phosphor material raw material (generatrix, a resurrection agent, ablator, etc.).

Alternatively, the barrier ribs 30 comprising the white phosphor material may be fabricated by a forming method employing a mold. That is, a model mold for the barrier ribs 30 is formed. A white phosphor material is inserted into the mold and is then heated and pressurized, thus completing the barrier ribs comprising the white phosphor material.

Alternatively, the barrier ribs 30 may be formed by mixing the material of the barrier rib and the white phosphor material. Preferably, a barrier rib material comprising the white phosphor material and low melting-point glass (a silica-based material), as major components, and aggregate, additives or the like, such as alumina or titania, if appropriate, may be used. The composition ratio of the white phosphor material is not specially limited, but may be set to 5 to 80 w % of the total weight of the barrier rib taking luminance and the material cost into consideration. Preferably, the composition ratio of the white phosphor material may be set to 60 to 75 w % of the total weight of the barrier rib.

The glass may use glass in which any one of alkali metals (Na, K, Li) or alkaline earths (Ca, Mg, Ba), Al, Zn, Sr, Ti, Zr, Fe, and so on is partially contained in borosilicate glass in which oxides, such as B, P, Ge, As, and V, are integrated, other than silicate glass or Si.

More particularly, unleaded glass in which one kind of atom or two or more kinds of atoms, which are selected from a group comprising Li, Al, K, Ca, Zn, and Sr, are partially contained in borosilicate glass comprising oxide containing Si and B is preferred since it has a low melting point and a low sintering temperature and a high density and transparency.

The method of forming the barrier ribs 30 comprising the white phosphor material will be described in detail below. The following methods may be used selectively.

A method of forming the barrier ribs 30 according to the present invention using the screen-printing method will be described below. A barrier rib material, such as glass paste comprising the white phosphor material, is printed on an underlying structure to a predetermined thickness and is then dried. In order to form a barrier rib having a desired height, the screen-printing method is repeatedly performed on the same place. An organic material is then removed by performing sintering of a high temperature in a sintering furnace, thereby completing the barrier ribs of the present invention.

The screen-printing method is advantageous in that it can be performed using relatively simple apparatuses, such as a screen-printing apparatus and a sintering furnace, and has a high use efficiency of materials.

A method of forming the barrier ribs 30 according to the present invention using the etching method will be described below. A material of the barrier ribs 30, such as frit glass paste comprising the white phosphor material, is coated on an underlying structure and is then sintered. A dry film resist (DFR) is coated on the resulting surface. Exposure and development processes are then performed to form a mask resist pattern. The frit glass layer is etched to a predetermined depth using an etchant by employing the mask resist pattern, thus forming the barrier ribs 30. Thereafter, the mask resist is stripped and sintering is performed again, thereby completing the barrier ribs according to the present invention.

The etching method is advantageous in that it can fabricate a large-sized panel and a panel of high resolutions at low cost, and can easily obtain barrier rib patterns having a variety of shapes.

A method of forming the barrier ribs 30 according to the present invention using the sandblast method will be described below. A material for forming barrier ribs, which comprises the white phosphor material, is formed on an underlying structure. A mask is patterned on the material. Cutting particles, such as ceramic particles or calcium carbonate ($CaCO_3$)-based particulates, are blown at high pressure so that unnecessary portions are cut to a predetermined depth using its kinetic energy, thereby forming the barrier ribs 30.

The sandblast method is advantageous in that it can fabricate barrier ribs having a line width of up to 50 μm and can also fabricate barrier ribs having high definitions and a vertical wall shape.

A method of forming the barrier ribs 30 according to the present invention using a squeezing method will be described below. In this method, the white phosphor material or a paste comprising the white phosphor material is first coated on an underlying structure to a predetermined thickness. A thick paste is coated on the coated paste and exposure and development processes are then performed. The remaining resist negative (−) pattern is filled with the white phosphor material or the paste comprising the white phosphor material and is then sintered. Thereafter, the remaining negative (−) pattern is removed, thus completing the barrier ribs of the present invention.

The squeezing method can form barrier ribs having a micro shape because it employs a light source, and is suitable for a glass substrate.

A method of forming the barrier ribs 30 according to the present invention using a paste photolithography method will be described below. The paste photolithography method uses a photosensitive paste as the material of the barrier ribs 30. In this method, a paste of a photosensitive barrier rib matrix (30) material comprising the white phosphor material is thickly coated on an underlying structure and is then dried. A patterned mask is placed on the paste, and exposure and development processes are then performed. The remaining mask is sintered to form the barrier ribs 30 of the present invention. The method using the photosensitive paste as the material of the barrier ribs enables high precision and fineness in comparison with other fabrication methods of the barrier ribs.

As described above, the barrier ribs 30 are formed using the phosphor material. It makes unnecessary the process of coating additional phosphor materials on the barrier ribs. It can also save the manufacturing cost and reduce the manufacturing time. Since it is unnecessary to coat phosphors on the barrier ribs 30, the discharge space can be increased and high definition can be realized.

Figure 3:
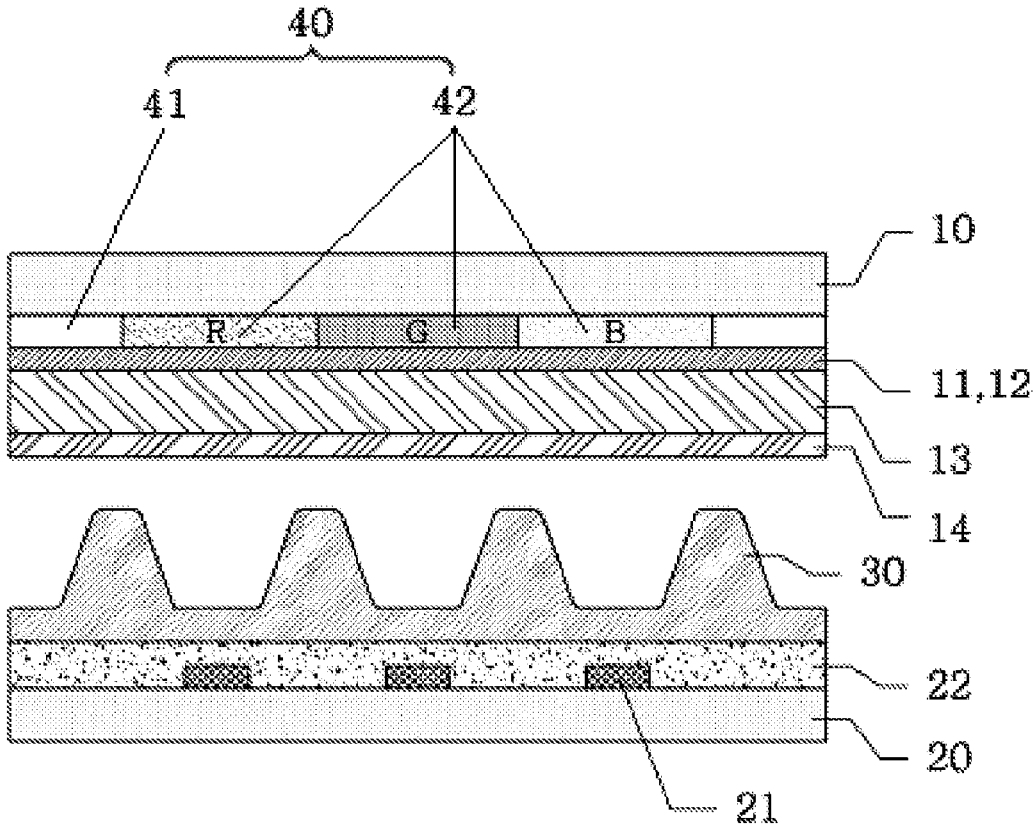
FIG. 3 is a cross-sectional view showing the construction of a PDP according to still another embodiment of the present invention.
Figure 4:
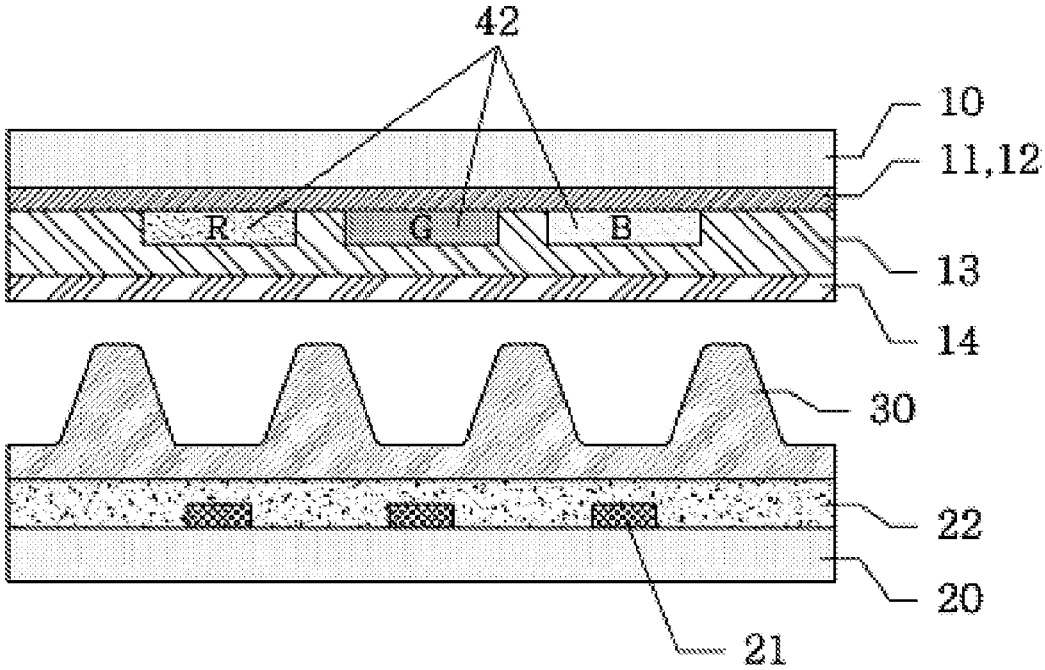
FIG. 4 is a cross-sectional view showing the construction of a PDP according to further another embodiment of the present invention.
Figure 5:
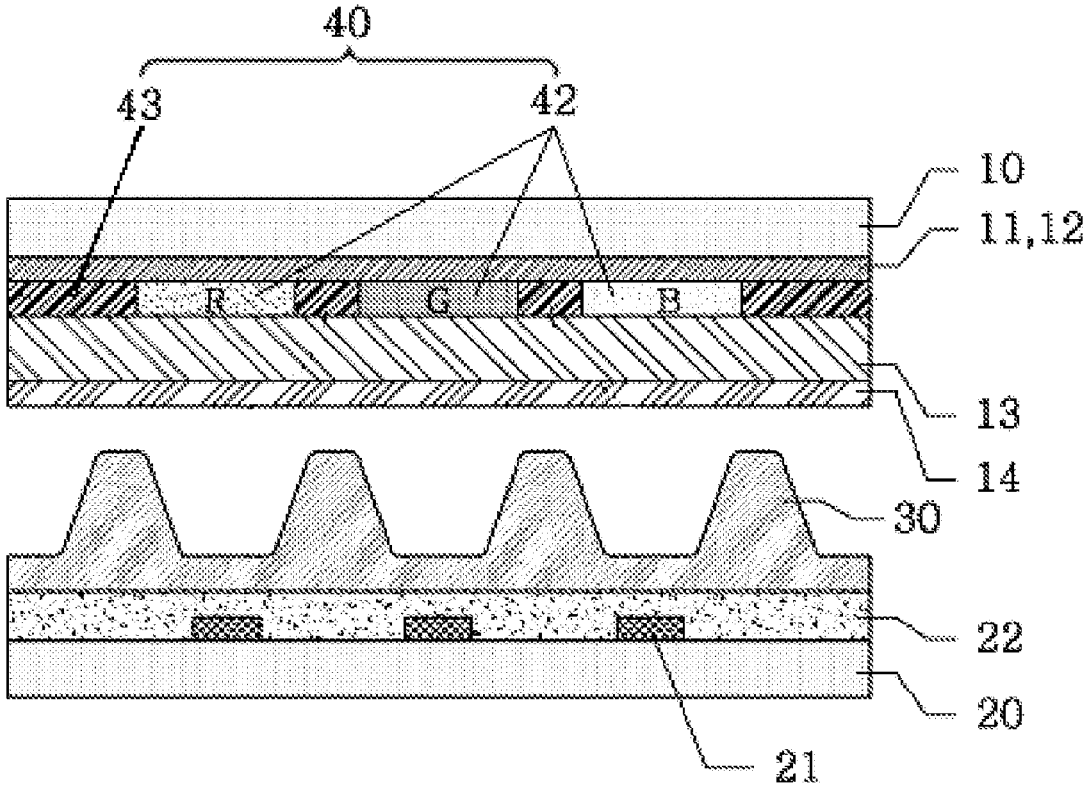
FIG. 5 is a cross-sectional view showing the construction of a PDP according to still another embodiment of the present invention.

FIGS. 3 to 5 are cross-sectional views showing the construction of a PDP according to another embodiment of the present invention.

As shown in FIGS. 3 and 4, the PDP comprises barrier ribs comprising a phosphor material. A color filter 40 may be formed below a front substrate 10, as shown in FIG. 3, and may be formed under the front substrate 10 with sustain electrodes 11 and 12 comprising bus electrodes being intervened between the color filter 40 and the front substrate 10, as shown in FIG. 4. That is, the color filter may be formed between the sustain electrode pairs and the dielectric layer. The color filter may comprise only R, G, and B color layers.

A method of forming the color filter 40 may employ the above-mentioned method.

Furthermore, as shown in FIG. 5, the color filter 40 may comprise black matrices 43 between R, G, and B color layers 42. The black matrices may serve to prevent unwanted color mixing between the discharge cells.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel (PDP), comprising;

a front panel comprising a dielectric layer formed to cover a plurality of sustain electrode pairs;

a rear panel comprising address electrodes formed to cross the sustain electrode pairs; and barrier ribs disposed between the front panel and the rear panel so as to form a discharge cell, the barrier ribs being formed from a mixture including phosphor materials.

2. The PDP of claim 1, wherein a color filter is further formed on the front substrate, below the front substrate, or between the plurality of sustain electrode pairs and the dielectric layer.

3. The PDP of claim 1, wherein the phosphor materials comprise red (R), green (G), and blue (B) phosphor materials.

4. The PDP of claim 1, wherein the phosphor materials comprise a white phosphor material.

5. The PDP of claim 1, wherein the mixture further comprises a silica-based glass.

6. The PDP of claim 1, wherein the phosphor material is used in an amount of 5 to 80 w % based on the total weight of the barrier ribs.

7. The PDP of claim 6, wherein the phosphor material is used in an amount of 60 to 75 w % based on the total weight of the barrier ribs.

8. The PDP of claim 2, wherein the color filter comprises red (R), green (G), and blue color layers.

9. The PDP of claim 2, wherein the color filter comprises a black matrix.

10. The PDP of claim 9, wherein the black matrix is formed between color layers of the color filter.

11. The PDP of claim 1, wherein the barrier ribs comprise first barrier ribs and second barrier ribs, and the barrier ribs have a closed type in which the first barrier ribs and the second barrier ribs cross to form discharge cell.

12. A PDP, comprising;

a front panel comprising a dielectric layer formed to cover a plurality of sustain electrode pairs;

a rear panel comprising address electrodes formed to cross the sustain electrode pairs;

barrier ribs disposed between the front substrate and the rear substrate so as to form a discharge cell, the barrier ribs being formed from a mixture including a white phosphor material that generates white light; and a color filter formed on the front substrate, below the front substrate, or between the plurality of sustain electrode pairs and the dielectric layer.

13. The PDP of claim 12, wherein the barrier ribs further comprise red (R), green (G), and blue (B) phosphor materials.

14. The PDP of claim 12, wherein the mixture further comprises a silica-based glass.

15. The PDP of claim 12, wherein the phosphor material is used in an amount of 5 to 80 w % based on the total weight of the barrier ribs.

16. The PDP of claim 15, wherein the phosphor material is used in an amount of 60 to 75 w % based on the total weight of the barrier ribs.

17. The PDP of claim 12, wherein the color filter comprises red (R), green (G), and blue (B) color layers.

18. The PDP of claim 12, wherein the color filter comprises a black matrix.

19. The PDP of claim 18, wherein the black matrix is formed between color layers of the color filter.

20. The PDP of claim 12, wherein the barrier ribs comprise first barrier ribs and second barrier ribs, and the barrier ribs have a closed type in which the first barrier ribs and the second barrier ribs cross to form discharge cell.

* * * * *

UNITED STATES PATENT AND TRADEMARK OFFICE

CERTIFICATE OF CORRECTION

PATENT NO. : 7,408,302 B2
APPLICATION NO. : 11/466646
DATED : August 5, 2008
INVENTOR(S) : Woong Kee Min It is certified that error appears in the above-identified patent and that said Letters Patent is hereby corrected as shown below:

Column 7, line 54, “comprising;” should be changed to --comprising:--

Column 8, line 18, “blue” should be changed to --blue (B)--

Column 8, line 28, “comprising;” should be changed to --comprising:--.

Signed and Sealed this

Eighteenth Day of November, 2008

JON W. DUDAS
*Director of the United States Patent and Trademark Office*